US006662687B2

(12) United States Patent
Garg

(10) Patent No.: US 6,662,687 B2
(45) Date of Patent: Dec. 16, 2003

(54) RATCHET WRENCH WITH IMPROVED FORCE DISTRIBUTION

(75) Inventor: Ajay Garg, Plano, TX (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 10/119,125

(22) Filed: Apr. 10, 2002

(65) Prior Publication Data

US 2003/0192408 A1 Oct. 16, 2003

(51) Int. Cl.[7] ..... B25B 13/46

(52) U.S. Cl. ..... 81/63.2; 81/61; 81/62; 81/63

(58) Field of Search ..... 81/61, 63, 177.7, 81/62, 63.2

(56) References Cited

U.S. PATENT DOCUMENTS

| | | | | |
|---|---|---|---|---|
| 207,117 | A | 8/1878 | Hammond | |
| 1,029,271 | A | 6/1912 | Bosserman | |
| 1,426,127 | A | 8/1922 | Tuttle | |
| 1,453,607 | A | 5/1923 | Saucier | |
| 1,868,840 | A | 7/1932 | McNaught et al. | |
| 1,883,618 | A | 10/1932 | Dodge | |
| 2,294,510 | A | 9/1942 | Nakano | |
| 3,186,265 | A | 6/1965 | Wenturine et al. | |
| 3,349,653 | A | 10/1967 | Kaufman et al. | |
| 3,838,614 | A | 10/1974 | O'Donnell | |
| 4,327,611 | A | 5/1982 | Catanese et al. | |
| 4,463,632 | A | 8/1984 | Parke | |
| 4,515,044 | A | 5/1985 | Harstad | |
| 4,622,870 | A | 11/1986 | Shirley | |
| 4,993,288 | A | 2/1991 | Anderson et al. | |
| D322,203 | S | 12/1991 | Kanyuck, Sr. | |
| 5,218,891 | A | 6/1993 | Olson et al. | |
| 5,230,263 | A | 7/1993 | Kwaka | |
| 5,280,740 | A | 1/1994 | Ernst | |
| 5,331,869 | A | 7/1994 | Webb | |
| 5,392,672 | A | 2/1995 | Larson et al. | |
| 5,454,283 | A | 10/1995 | Stefano | |
| 5,636,557 | A | 6/1997 | Ma | |
| 5,694,818 | A | 12/1997 | Nickipuck | |
| 5,738,192 | A | 4/1998 | Miner | |
| 5,862,723 | A | 1/1999 | Rowlands | |
| 5,870,932 | A | 2/1999 | Brooke | |
| 5,878,635 | A | 3/1999 | Hsieh | |
| 5,979,274 | A | 11/1999 | Hsieh | |
| 6,000,302 | A | 12/1999 | Chiang | |
| 6,301,999 | B1 | 10/2001 | Garg | |
| 2002/0096021 | A1 * | 7/2002 | Wei | 81/60 |
| 2003/0037642 | A1 * | 2/2003 | Liu | 81/60 |
| 2003/0136230 | A1 * | 7/2003 | Chen | 81/60 |

FOREIGN PATENT DOCUMENTS

| | | |
|---|---|---|
| GB | 2 168 634 | 6/1986 |

* cited by examiner

*Primary Examiner*—M. Rachuba
(74) *Attorney, Agent, or Firm*—Pillsbury Winthrop LLP

(57) ABSTRACT

The present application relates to a ratchet wrench with improved force distribution between the pawl and the ratchet gear.

28 Claims, 5 Drawing Sheets

RATCHET WRENCH WITH IMPROVED FORCE DISTRIBUTION

FIELD OF THE INVENTION

The present invention relates to a ratchet wrench for selectively applying torque to a fastener.

BACKGROUND OF THE INVENTION

FIG. 5 illustrates a prior art ratchet wrench 100. The prior art wrench has a wrench body 102 including a handle portion (not shown) and a head portion 106. A pawl 102 is shown in its gear driving position. In this gear driving position, the head portion 104 engages the pawl 102 so as to apply force to it during torque application is a "sidewards" direction of the pawl 102 (indicated by arrow F). That is, the force is applied mostly circumferentially with respect to the axis about which the gear 108 rotates. As a result, the force transmitted to the gear 108 by the pawl 106 tends to be focused at the teeth closest to the point of engagement. Specifically, the force is primarily focused at the outermost tooth of the pawl closest to the point of engagement. As a result, the remainder of the pawl teeth transmit considerably less force. This is an unsatisfactory load distribution.

SUMMARY OF THE INVENTION

One aspect of the present invention provides a ratchet wrench for applying torque to a fastener. The wrench comprises a wrench body having a handle portion configured to be manually grasped and a head portion providing a pawl engaging surface; and a ratchet gear constructed and arranged to be removably engaged with the fastener such that torque applied to the gear is transmitted to the fastener to affect rotation thereof. The ratchet gear is mounted to the wrench body such that the gear and the body are rotatable relative to one another about a gear axis, the ratchet gear having a plurality of gear teeth arranged on a radially outer peripheral surface thereof in circumferential relation with respect to the gear axis. A pawl is mounted to the wrench body and having a plurality of ratcheting teeth arranged in an arc essentially complementary to the gear teeth and a load receiving surface facing generally opposite the ratcheting teeth. The ratcheting teeth include a pair of outermost teeth provided at opposing ends of the arc and inner teeth therebetween.

The pawl has a gear driving position wherein the ratcheting teeth of the pawl are positioned for driving engagement with the gear teeth and the pawl engaging surface is positioned for driving engagement with the load receiving surface of the pawl such that a manual force applied in a first direction to the handle portion of the wrench body is transmitted from the wrench body to the pawl via the driving engagement between the pawl engaging surface and the load receiving surface and from the pawl to the ratchet gear via the driving engagement between the ratcheting teeth and the gear teeth so as to apply torque to the gear. The pawl is constructed and arranged with respect to the gear teeth and the pawl engaging surface such that, as the manual force is being transmitted to the gear via the pawl, the total amount of force applied to the gear is distributed among the ratcheting teeth in such a manner that an amount of force applied to the gear by each of the inner ratcheting teeth is greater than or equal to an amount of force applied to the gear by either of the outermost ratcheting teeth.

The wrench further comprises a biasing element engaged with the pawl and biasing the pawl to the gear driving position. The biasing element is constructed and arranged such that a manual force applied to the handle portion in a second direction opposite the first direction causes rotation of the wrench body relative to the ratchet gear with the ratcheting teeth of the pawl repeatedly ratcheting over the gear teeth against the biasing of the biasing element.

Another aspect of the invention provides a ratchet wrench for applying torque to a fastener. The wrench comprises a wrench body having a handle portion configured to be manually grasped and a head portion providing a pawl engaging surface; and a ratchet gear constructed and arranged to be removably engaged with the fastener such that torque applied to the gear is transmitted to the fastener to affect rotation thereof The ratchet gear is mounted to the wrench body such that the gear and the body are rotatable relative to one another about a gear axis. The ratchet gear has a plurality of gear teeth arranged on a radially outer peripheral surface thereof in circumferential relation with respect to the gear axis. A pawl is mounted to the wrench body and has a plurality of ratcheting teeth arranged in an arc essentially complementary to the gear teeth and a load receiving surface facing generally opposite the ratcheting teeth. The ratcheting teeth include a pair of outermost teeth provided at opposing ends of the arc and inner teeth therebetween.

The pawl has a gear driving position wherein the ratcheting teeth of the pawl are positioned for driving engagement with the gear teeth and the pawl engaging surface is positioned for driving engagement with the load receiving surface of the pawl such that a manual force applied in a first direction to the handle portion of the wrench body is transmitted from the wrench body to the pawl via the driving engagement between the pawl engaging surface and the load receiving surface and from the pawl to the ratchet gear via the driving engagement between the ratcheting teeth and the gear teeth so as to apply torque to the gear. The load receiving surface is positioned on or between two outer radial lines of four imaginary radial lines dividing the arc into five equal imaginary arcuate sectors.

The wrench also comprises a biasing element engaged with the pawl and biasing the pawl to the gear driving position. The biasing element is constructed and arranged such that a manual force applied to the handle portion in a second direction opposite the first direction causes rotation of the wrench body relative to the ratchet gear with the ratcheting teeth of the pawl repeatedly ratcheting over the gear teeth against the biasing of the biasing element.

Other objects, advantages, and features of the present invention will become apparent from the following detailed description, the accompanying drawings and the appended claims.

DETAILED DESCRIPTION OF THE ILLUSTRATED EMBODIMENT

Figure 1:
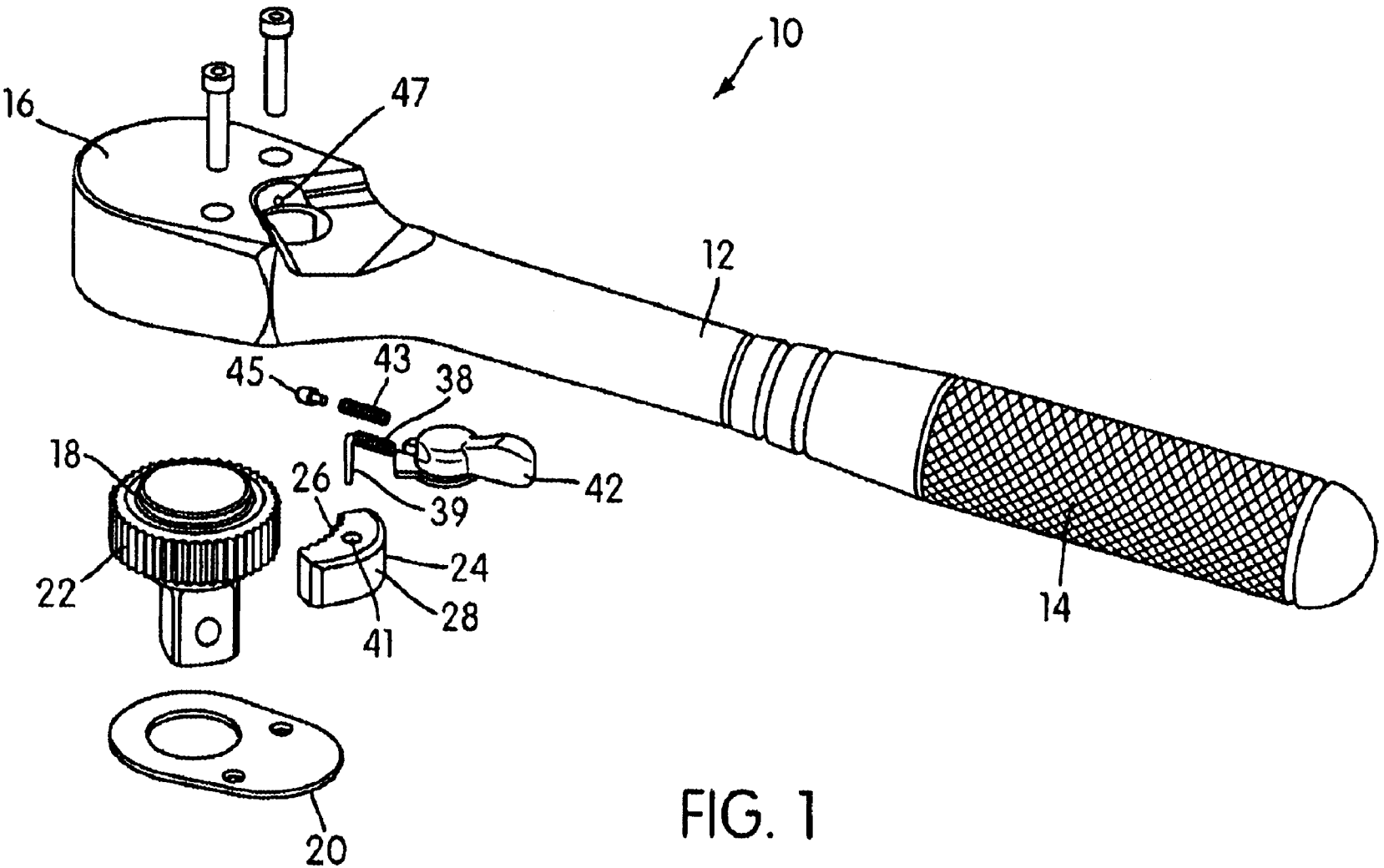
FIG. 1 is an exploded view of an exemplary ratchet wrench constructed in accordance with the principles of the present invention.

FIG. 1 is an exploded perspective view of a ratchet wrench, generally indicated 10, constructed in accordance with the present invention. The illustrated wrench 10 is merely an exemplary embodiment of the invention and is not intended to be limiting. The wrench 10 includes a wrench body, generally indicated at 12. The wrench body 12 includes a handle portion 14 configured to be manually grasped and a head portion 16. In the illustrated embodiment, the head portion 16 is formed integrally with the handle portion 14. The head portion 16, however, may be formed separately from the handle portion 14 and movably connected thereto by a pivot pin for angular adjustment.

The wrench 10 includes a ratchet gear 18. The ratchet gear 18 is constructed and arranged to be removably engaged with a fastener such that torque applied to the gear 18 is transmitted to the fastener to affect rotation thereof. In the illustrated embodiment, the gear 18 is provided with an axially extending lug 19 on which removable sockets are received. Alternatively, the gear 18 could be of the ring gear type with a hole formed therethrough. The hole has an internal periphery configured for suitable engagement with a polygonally-headed fastener, such as a nut or bolt. In general, the ratchet gear 18 can have any configuration for directly or indirectly engaging a fastener for torque application.

The ratchet gear 18 is mounted to the wrench body such that the gear 18 and the wrench body 12 are rotatable relative to one another about a gear axis. In the illustrated embodiment, the gear 18 is retained in the cavities of the head portion 16 by a cover plate 20.

The gear 18 has a plurality of gear teeth 22 arranged on a radially outer peripheral surface thereof in circumferential relation with respect to said gear axis. Each of the gear teeth having opposing tooth surfaces. The teeth 22 may be symmetrical or asymmetrical. The teeth 22 may be recessed or protruding outwardly from the gear 18.

The wrench 10 further comprises a pawl 24 mounted to the wrench body 12. The pawl 24 has a plurality of ratcheting teeth 26 arranged in an arc. The arc is essentially complementary to the gear teeth 22. The pawl 24 also has a load receiving surface 28 facing generally opposite the ratcheting teeth 26. The ratcheting teeth 26 include a pair of outermost teeth 30 provided at opposing ends of the arc and inner teeth 32 therebetween.

Figure 2:
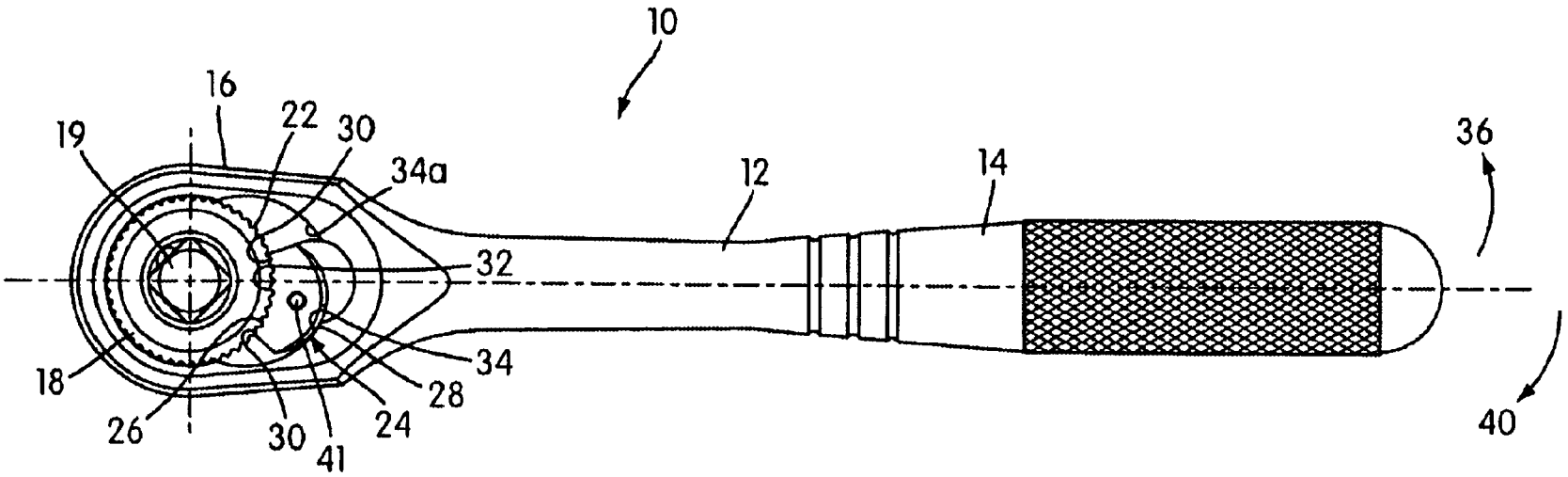
FIG. 2 is a bottom plan view showing the pawl in a gear driving position with other components of the wrench removed for clarity.
Figure 3:
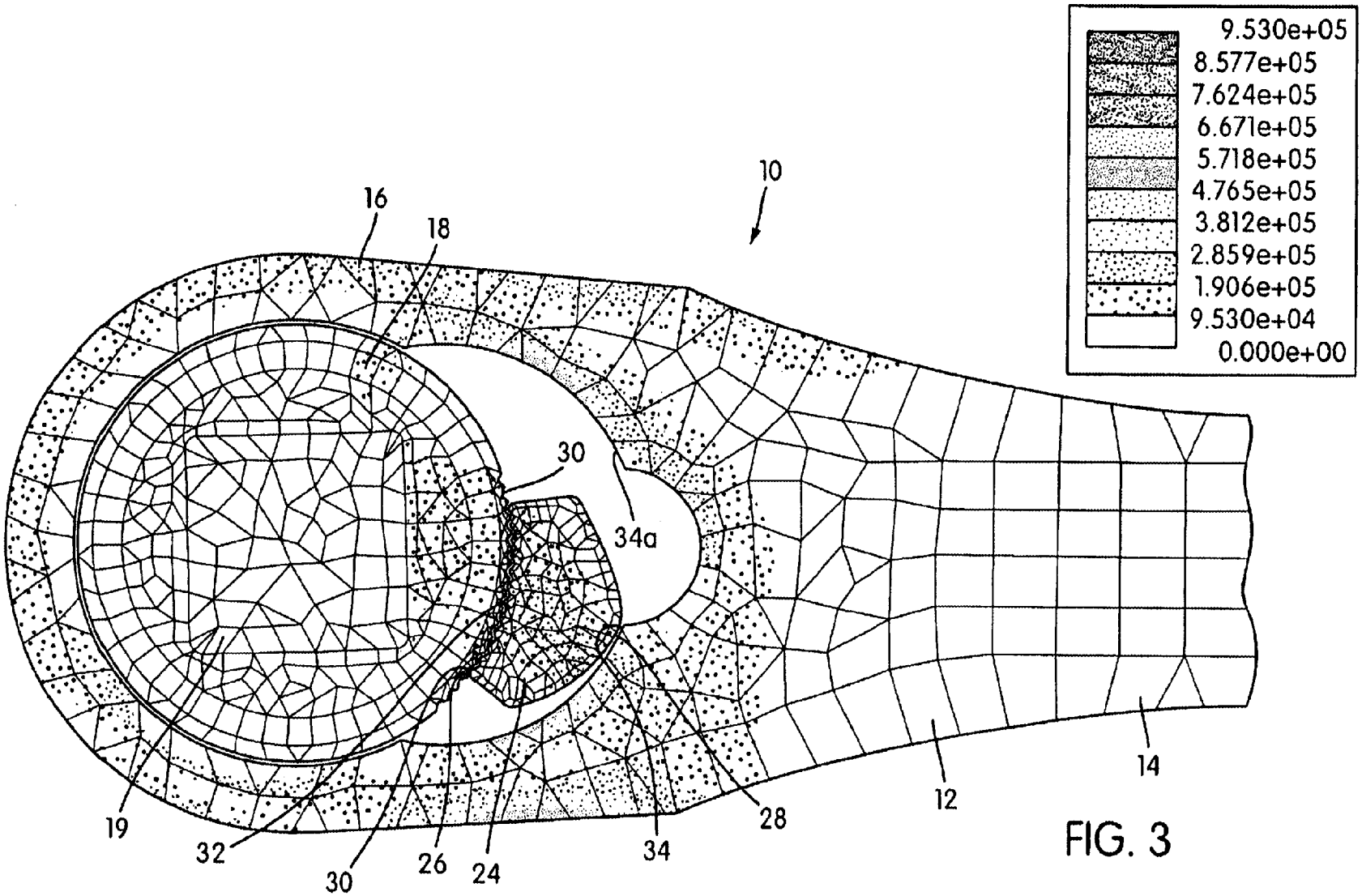
FIG. 3 is a bottom plan schematic view showing the stress distribution between the pawl and the ratchet gear in a gray scale plot, the units being expressed in terms of pounds per square inch (PSI).
Figure 4:
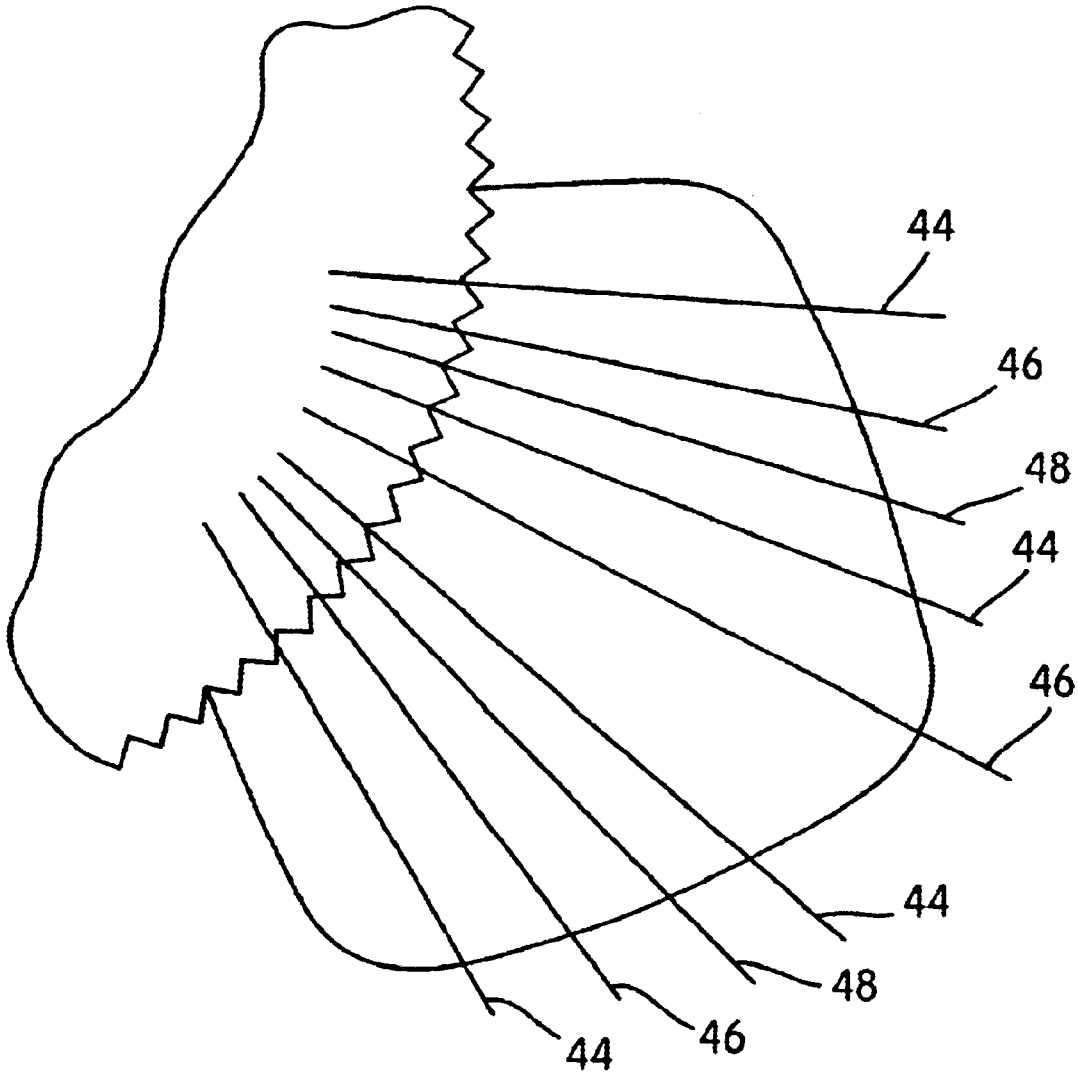
FIG. 4 is a view isolating the pawl and a portion of the gear 18 to illustrate imaginary lines dividing the area of teeth.

The pawl 24 has a gear driving position, shown in FIGS. 2 and 3. In the paw's gear driving position, the pawl 24 is positioned for driving engagement with the gear teeth 22 and a pawl engaging surface 34 of the wrench body 12 is positioned for driving engagement with the load receiving surface 28. As a result of these driving engagements, a manual force applied in a first direction (indicated with arrow 36) is transmitted (a) from the wrench body 12 to the pawl 24 via the driving engagement between the pawl engaging surface 34 and the load receiving surface 28 and (b) from the pawl 24 to the ratchet gear 18 via the driving engagement between the ratcheting teeth 26 and the gear teeth 22. This applies torque to the gear 18 for rotating the fastener.

The wrench 10 also comprises a biasing element, which in the illustrated embodiment is in the form of a coil spring 38. Any suitable biasing element may be used in place of a coil spring 38. For example, a leaf spring could be used. Likewise, any resilient structure suitable for applying a biasing force to the pawl 24 may be used. The spring 38 is engaged with the pawl 24 and biases the pawl 24 to its gear driving position. The spring 38 is constructed and arranged such that a manual force applied to the handle portion 14 in a second direction (indicated with arrow 40) opposite the first direction 36 causes rotation of the wrench body 12 relative to the ratchet gear 18 with the ratcheting teeth 26 of the pawl 24 repeatedly ratcheting over the gear teeth 22 against the biasing of the spring 38.

In the illustrated embodiment of FIG. 1, the ratchet wrench 10 is of the reversible type. Thus, the wrench body 12 has an opposite pawl engaging surface 34*a*. The pawl 24 is movable generally circumferentially with respect to the ratchet gear 18 to an opposite gear driving position opposite the one illustrated in FIG. 2. In this opposite gear driving position, the ratcheting teeth 26 are positioned for an opposite driving engagement with the gear teeth 22 and the opposite pawl engaging surface 34*a* is positioned for an opposite driving engagement with the load receiving surface 28 of the pawl 24. As a result of these opposite driving engagements, a manual force applied in the second direction 40 the handle portion 14 of the wrench body 12 is transmitted (a) from the wrench body 12 to the pawl via the opposite driving engagement between the opposite pawl engaging surface 34*a* and the load receiving surface 28 and (b) from the pawl 24 to the ratchet gear 18 via the opposite driving engagement between the ratcheting teeth 26 and the gear teeth 22. This applies an opposite torque to the gear 18 for rotating a fastener in an opposite direction.

The wrench 10 in the illustrated embodiment further comprises a reversing switch member 42 mounted to the head portion 16. The switch member 16 enables the user to switch the pawl 24 between the two gear driving positions. In the illustrated embodiment, the spring 38 is positioned between the pawl 24 and the switch member 16. The spring 38 is arranged such that (a) when the pawl 24 is in the gear driving position, a manual force applied to the handle portion 14 in the second direction 40 causes rotation of the wrench body 12 relative to the gear 18 with the ratcheting teeth 26 repeatedly ratcheting over the gear teeth 22 against the biasing of the spring 38 and (b) when the pawl 24 is in the opposite gear driving position, a manual force applied to the handle portion 14 in the first direction 36 causes rotation of the wrench body 12 relative to the ratchet gear 18 with the ratcheting teeth 26 repeatedly ratcheting over the gear teeth 22 against the biasing of the spring 38.

In the illustrated embodiment, the pawl 24 is pivotally mounted on the upright leg of an L-shaped member 39, which leg is received in a bore 41 on the pawl 24. The spring 38 is mounted on the other leg of the L-shaped member 39, which other leg is received in a bore in the switch member 42. As the switch member 42 is pivoted between positions, the spring 38 changes angular positions and moves the pawl 24 circumferentially relative to the gear 18. The pawl 24 pivots on the leg of the L-shaped member 39 during this travel. The switch member 42 also includes a spring 42 and a detent member in the form of a detent ball 45 that engages a pair of recesses 47 on the head portion 16 to retain the switch member 42 in either of its two positions. For further details on this aspect of the illustrated, non-limiting construction, reference may be made to U.S. application Ser. No. 09/805,434, filed Mar. 14, 2001, entirety of which is hereby incorporated herein by reference. The construction used in U.S. Pat. No. 5,957,009 may also be used. Regardless of the construction, any type of suitable mechanism may be used for switching the pawl 24 between its gear driving positions.

Alternatively, the ratchet wrench 10 may be of the one-way ratcheting type wherein the pawl 24 only has a single gear driving position. This type of wrench 10 is devoid of a reversing switch 42. In this type of wrench 10, the gear 18 is preferably of the ring gear type illustrated with a hole formed therethrough for receiving a fastener. This enables the wrench 10 to be flipped over for rotating the fastener in an opposite direction.

The pawl 24 is constructed and arranged with respect to the gear teeth 22 and the pawl engaging surface 34*a* (and, in the reversible type of wrench, pawl engaging surface 34*a*) such that, as the manual force is being transmitted to the gear 18 via the pawl 24, the total amount of force applied to the gear 18 is distributed among the ratcheting teeth 26 in such a manner that an amount of force applied to the gear 18 by each of the inner ratcheting teeth 32 is greater than or equal to an amount of force applied to the gear teeth 26 by either of the outermost ratcheting teeth 30. That is, the force is distributed among the teeth 26 such that it is not focused to a greater extent on either of the outermost teeth 32, and instead is distributed more broadly across all the teeth 26. This distribution can be appreciated from the stress distribution plot provided as FIG. 3, wherein the units shown in the legend are expressed in the units of pounds per square inch (PSI). A comparison of this stress. distribution with that shown in FIG. 5 of the prior art illustrates the improved distribution.

Figure 5:
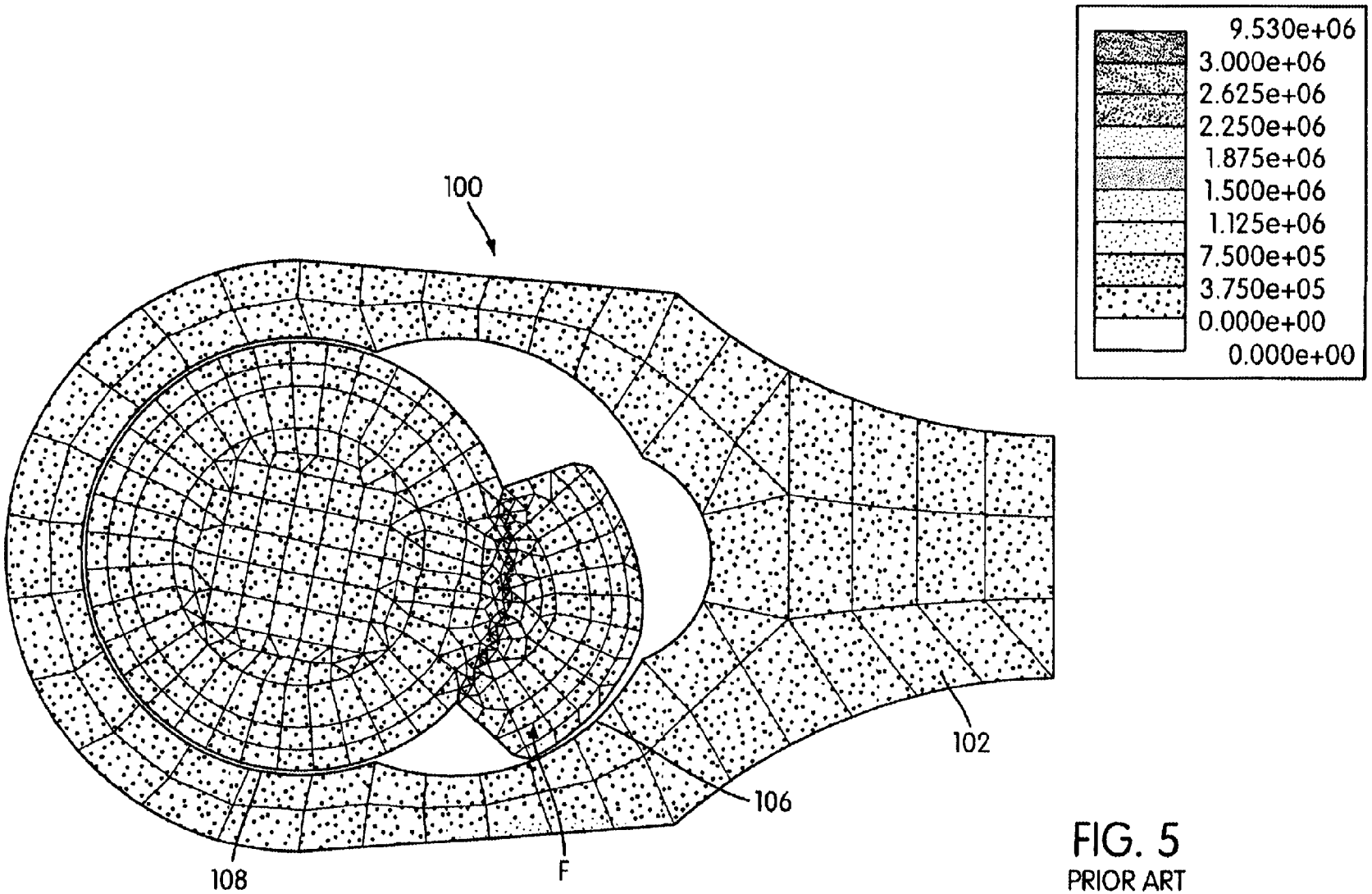
FIG. 5 PRIOR ART
FIG. 5 is a bottom plan schematic view similar to FIG. 4 showing a prior art construction.

Color versions of FIGS. 3 and 5 are being filed herewith in an Appendix for better clarity. This Appendix is incorporated into the present application by reference.

The force distribution discussed in the above paragraph may be achieved by positioning the load receiving surface 28 such that it is on or between two outer radial lines of four imaginary radial lines 44 dividing the arc of the ratcheting teeth 26 into five equal imaginary arcuate sectors. Preferably the load receiving surface 28 is positioned on or between two outer radial lines of three imaginary radial lines 46 dividing the arc into four imaginary arcuate sectors. More preferably, the load receiving surface 28 is positioned on or between two imaginary radial lines 48 dividing the arc into three equal imaginary sectors. Still more preferably, the load receiving surface 28 is positioned on or between two inner radial lines of the four imaginary radial lines 44 dividing the arc into five equal imaginary sectors. In the illustrated embodiment, the load receiving surface 28 is positioned on an imaginary line (which is the middle line of lines 46) bisecting the arc into two imaginary equal sectors.

It should be understood that while the geometric configuration discussed in the preceding paragraph preferably achieves the load distribution discussed in the secondmost preceding paragraph, that load distribution may be achieved using other geometries and the geometries mentioned are not specifically necessary achieve such a load distribution The aforementioned geometries discussed above achieve superior load distribution compared to prior art ratchet wrenches; however, the load distribution achieved need not be limited to the type wherein the force applied by the inner teeth 32 is greater than or equal to the force applied by the outermost teeth 32. Other variations of improved load distribution may occur.

Most preferably, the total force is distributed essentially evenly between all the ratcheting teeth 26. Such a distribution, however, is only preferred and the invention is not limited to such distribution.

In the illustrated embodiment, the load receiving surface 28 is provided on a back wall 50 of the pawl 24 opposite the ratcheting teeth 26. However, this arrangement is not intended to be limiting. For example, the load receiving surface 28 may be spaced inward toward the teeth 26 from the back wall 50.

The foregoing description has been provided solely for illustrating the structural and functional principles of the present invention and is not intended to be limiting. To the contrary, the present invention is intended to encompass all modifications, substitutions, and alterations within the spirit and scope of the appended claims.

What is claimed:

1. A ratchet wrench for applying torque to a fastener, said wrench comprising:

a wrench body having a handle portion configured to be manually grasped and a head portion providing a pawl engaging surface;

a ratchet gear constructed and arranged to be removably engaged with the fastener such that torque applied to said gear is transmitted to the fastener to affect rotation thereof, said ratchet gear being mounted to said wrench body such that said gear and said body are rotatable relative to one another about a gear axis, said ratchet gear having a plurality of gear teeth arranged on a radially outer peripheral surface thereof in circumferential relation with respect to said gear axis;

a pawl mounted to said wrench body and having a plurality of ratcheting teeth arranged in an arc essentially complementary to said gear teeth and a load receiving surface facing generally opposite said ratcheting teeth, said ratcheting teeth including a pair of outermost teeth provided at opposing ends of said arc and inner teeth therebetween;

said pawl having a gear driving position wherein said ratcheting teeth of said pawl are positioned for driving engagement with said gear teeth and said pawl engaging surface is positioned for driving engagement with said load receiving surface of said pawl such that a manual force applied in a first direction to the handle portion of said wrench body is transmitted from said wrench body to said pawl via the driving engagement between said pawl engaging surface and said load receiving surface and from said pawl to said ratchet gear via the driving engagement between said ratcheting teeth and said gear teeth so as to apply torque to said gear;

said pawl being constructed and arranged with respect to said gear teeth and said pawl engaging surface such that, as said manual force is being transmitted to said gear via said pawl, the total amount of force applied to said gear is distributed among said ratcheting teeth in such a manner that an amount of force applied to said gear by each of said inner ratcheting teeth is greater than or equal to an amount of force applied to said gear by either of said outermost ratcheting teeth; and a biasing element engaged with said pawl and biasing said pawl to said gear driving position, said biasing element being constructed and arranged such that a manual force applied to said handle portion in a second direction opposite said first direction causes rotation of said wrench body relative to said ratchet gear with said ratcheting teeth of said pawl repeatedly ratcheting over said gear teeth against the biasing of said biasing element.

2. A ratchet wrench according to claim 1, wherein said load receiving surface is positioned on or between two outer radial lines of four imaginary radial lines dividing said arc into five equal imaginary arcuate sectors.

3. A ratchet wrench according to claim 2, wherein said load receiving surface is positioned on or between two outer radial lines of three imaginary radial lines dividing said arc into four equal imaginary arcuate sectors.

4. A ratchet wrench according to claim 3, wherein said load receiving surface is positioned on or between two imaginary radial lines dividing said arc into three equal imaginary arcuate sectors.

5. A ratchet wrench according to claim 4, wherein said load receiving surface is positioned on or between two inner radial lines of said four imaginary radial lines dividing said arc into five equal imaginary arcuate sectors.

6. A ratchet wrench according to claim 5, wherein said load receiving surface is positioned on an imaginary radial line bisecting said arc into two equal imaginary sectors.

7. A ratchet wrench according to claim 1, wherein said handle portion is integrally formed with said head portion.

8. A ratchet wrench according to claim 1, wherein said load receiving surface is a provided on a back wall of said pawl opposite said ratcheting teeth.

9. A ratchet wrench according to claim 1, wherein said wrench is of the one-way ratcheting type and devoid of a reversing switch.

10. A ratchet wrench according to claim 1, wherein said head portion has an opposite pawl engaging surface opposite the aforesaid pawl engaging surface and wherein said pawl is movable generally circumferentially with respect to said ratchet gear to an opposite gear driving position opposite the aforesaid gear driving position wherein in said opposite gear driving position said ratcheting teeth of said pawl are positioned for an opposite driving engagement with said gear teeth and said opposite pawl engaging surface is positioned for an opposite driving engagement with said load receiving surface of said pawl such that a manual force applied in said second direction to the handle portion of said wrench body is transmitted from said wrench body to said pawl via the opposite driving engagement between said opposite pawl engaging surface and said load receiving surface and from said pawl to said ratchet gear via the opposite driving engagement between said ratcheting teeth and said gear teeth so as to apply an opposite torque to said gear;

said pawl being constructed and arranged with respect to said gear teeth and said opposite pawl engaging surface such that, as said manual force is being transmitted to said gear via said pawl in said opposite gear driving position, the total amount of force applied to said gear is distributed among said ratcheting teeth in such a manner that an amount of force applied to said gear by each of said inner ratcheting teeth is greater than or equal to an amount of force applied to said gear by either of said outermost ratcheting teeth;

said wrench further comprising a reversing switch member mounted to said head portion, said switch member enabling a user to switch said pawl between said gear driving positions;

said biasing element being positioned between said pawl and said switch member and being constructed and arranged such that (a) when said pawl is in said gear driving position, a manual force applied to said handle portion in the second direction causes rotation of said wrench body relative to said ratchet gear with said ratcheting teeth of said pawl repeatedly ratcheting over said gear teeth against the biasing of said biasing element and (b) when said pawl is in said opposite gear driving position, a manual force applied to said handle portion in the first direction causes rotation of said wrench body relative to said ratchet gear with said ratcheting teeth of said pawl repeatedly ratcheting over said gear teeth against the biasing of said biasing element.

11. A ratchet wrench according to claim 10, wherein said load receiving surface is positioned on or between two outer radial lines of four imaginary radial lines dividing said arc into five equal imaginary arcuate sectors.

12. A ratchet wrench according to claim 11, wherein said load receiving surface is positioned on or between two outer radial lines of three imaginary radial lines dividing said arc into four equal imaginary arcuate sectors.

13. A ratchet wrench according to claim 12, wherein said load receiving surface is positioned on or between two imaginary radial lines dividing said arc into three equal imaginary arcuate sectors.

14. A ratchet wrench according to claim 13, wherein said load receiving surface is positioned on or between two inner radial lines of said four imaginary radial lines dividing said arc into five equal imaginary arcuate sectors.

15. A ratchet wrench according to claim 14, wherein said load receiving surface is positioned on an imaginary radial line bisecting said arc into two equal imaginary sectors.

16. A ratchet wrench for applying torque to a fastener, said wrench comprising:

a wrench body having a handle portion configured to be manually grasped and a head portion providing a pawl engaging surface;

a ratchet gear constructed and arranged to be removably engaged with the fastener such that torque applied to said gear is transmitted to the fastener to affect rotation thereof, said ratchet gear being mounted to said wrench body such that said gear and said body are rotatable relative to one another about a gear axis, said ratchet gear having a plurality of gear teeth arranged on a radially outer peripheral surface thereof in circumferential relation with respect to said gear axis;

a pawl mounted to said wrench body and having a plurality of ratcheting teeth arranged in an arc essentially complementary to said gear teeth and a load receiving surface facing generally opposite said ratcheting teeth, said ratcheting teeth including a pair of outermost teeth provided at opposing ends of said arc and inner teeth therebetween;

said pawl having a gear driving position wherein said ratcheting teeth of said pawl are positioned for driving engagement with said gear teeth and said pawl engaging surface is positioned for driving engagement with said load receiving surface of said pawl such that a manual force applied in a first direction to the handle portion of said wrench body is transmitted from said wrench body to said pawl via the driving engagement between said pawl engaging surface and said load receiving surface and from said pawl to said ratchet gear via the driving engagement between said ratcheting teeth and said gear teeth so as to apply torque to said gear;

said load receiving surface being positioned on or between two outer radial lines of four imaginary radial lines dividing said arc into five equal imaginary arcuate sectors; and a biasing element engaged with said pawl and biasing said pawl to said gear driving position, said biasing element being constructed and arranged such that a manual force applied to said handle portion in a second direction opposite said first direction causes rotation of said wrench body relative to said ratchet gear with said ratcheting teeth of said pawl repeatedly ratcheting over said gear teeth against the biasing of said biasing element.

17. A ratchet wrench according to claim 16, wherein said load receiving surface is positioned on or between two outer radial lines of three imaginary radial lines dividing said arc into four equal imaginary arcuate sectors.

18. A ratchet wrench according to claim 17, wherein said load receiving surface is positioned on or between two imaginary radial lines dividing said arc into three equal imaginary arcuate sectors.

19. A ratchet wrench according to claim 18, wherein said load receiving surface is positioned on or between two inner radial lines of said four imaginary radial lines dividing said arc into five equal imaginary arcuate sectors.

20. A ratchet wrench according to claim 19, wherein said load receiving surface is positioned on an imaginary radial line bisecting said arc into two equal imaginary sectors.

21. A ratchet wrench according to claim 16, wherein said handle portion is integrally formed with said head portion.

22. A ratchet wrench according to claim 16, wherein said load receiving surface is a provided on a back wall of said pawl opposite said ratcheting teeth.

23. A ratchet wrench according to claim 16, wherein said wrench is of the one-way ratcheting type and devoid of a reversing switch.

24. A ratchet wrench according to claim 16, wherein said head portion has an opposite pawl engaging surface opposite the aforesaid pawl engaging surface and wherein said pawl is movable generally circumferentially with respect to said ratchet gear to an opposite gear driving position opposite the aforesaid gear driving position wherein in said opposite gear driving position said ratcheting teeth of said pawl are positioned for an opposite driving engagement with said gear teeth and said opposite pawl engaging surface is positioned for an opposite driving engagement with said load receiving surface of said pawl such that a manual force applied in said second direction to the handle portion of said wrench body is transmitted from said wrench body to said pawl via the opposite driving engagement between said opposite pawl engaging surface and said load receiving surface and from said pawl to said ratchet gear via the opposite driving engagement between said ratcheting teeth and said gear teeth so as to apply an opposite torque to said gear;

said wrench further comprising a reversing switch member mounted to said head portion, said switch member enabling a user to switch said pawl between said gear driving positions;

said biasing element being positioned between said pawl and said switch member and being constructed and arranged such that (a) when said pawl is in said gear driving position, a manual force applied to said handle portion in the second direction causes rotation of said wrench body relative to said ratchet gear with said ratcheting teeth of said pawl repeatedly ratcheting over said gear teeth against the biasing of said biasing element and (b) when said pawl is in said opposite gear driving position, a manual force applied to said handle portion in the first direction causes rotation of said wrench body relative to said ratchet gear with said ratcheting teeth of said pawl repeatedly ratcheting over said gear teeth against the biasing of said biasing element.

25. A ratchet wrench according to claim 24, wherein said load receiving surface is positioned on or between two outer radial lines of three imaginary radial lines dividing said arc into four equal imaginary arcuate sectors.

26. A ratchet wrench according to claim 25, wherein said load receiving surface is positioned on or between two imaginary radial lines dividing said arc into three equal imaginary arcuate sectors.

27. A ratchet wrench according to claim 26, wherein said load receiving surface is positioned on or between two inner radial lines of said four imaginary radial lines dividing said arc into five equal imaginary arcuate sectors.

28. A ratchet wrench according to claim 27, wherein said load receiving surface is positioned on an imaginary radial line bisecting said arc into two equal imaginary sectors.

* * * * *